United States Patent [19]

Van Oord

[11] Patent Number: 4,870,809

[45] Date of Patent: Oct. 3, 1989

[54] PACKAGING DEVICE WITH IMPROVED SUPPLY STATION

[75] Inventor: Jan J.J. Van Oord, Ulvenhout, Netherlands

[73] Assignee: Breda Packaging B.V., Netherlands

[21] Appl. No.: 192,668

[22] Filed: May 10, 1988

[30] Foreign Application Priority Data

May 14, 1987 [NL] Netherlands ..... 8701166

[51] Int. Cl.[4] ..... B65B 35/30

[52] U.S. Cl. ..... 53/531; 221/198

[58] Field of Search ..... 221/111, 198; 53/531

[56] References Cited

FOREIGN PATENT DOCUMENTS 215341 3/1987 European Pat. Off. ..... 53/531

2601648 1/1988 France ..... 53/531

*Primary Examiner*—W. Donald Bray

*Attorney, Agent, or Firm*—John P. Snyder

[57] ABSTRACT

A device for group-wise packaging of objects such as jars, which device consists substantially of a frame (1), a belt-conveyor (12) carried by the frame, a grouping station disposed along the belt conveyor, a station for forming and feeding of a tray under the group, a station for arranging a covering material over the group of objects standing on the tray and a supply station (5) for the blanks (C) disposed standing in a row which are to be folded in each case into a tray; wherein the supply station (5) is provided with a carrier (9) for accomodating a second row of upright blanks (C), which carrier (9) can be conveyed from a first position for the arrangement of the row of blanks into a second delivery position and vice versa, so making it possible to arrange the blanks at a location that is more easily accessible for personnel and to doubling the time interval for replenishing the blanks, resulting in personnel having more time for supervising of the further packaging process.

11 Claims, 3 Drawing Sheets

PACKAGING DEVICE WITH IMPROVED SUPPLY STATION

Figure 1:
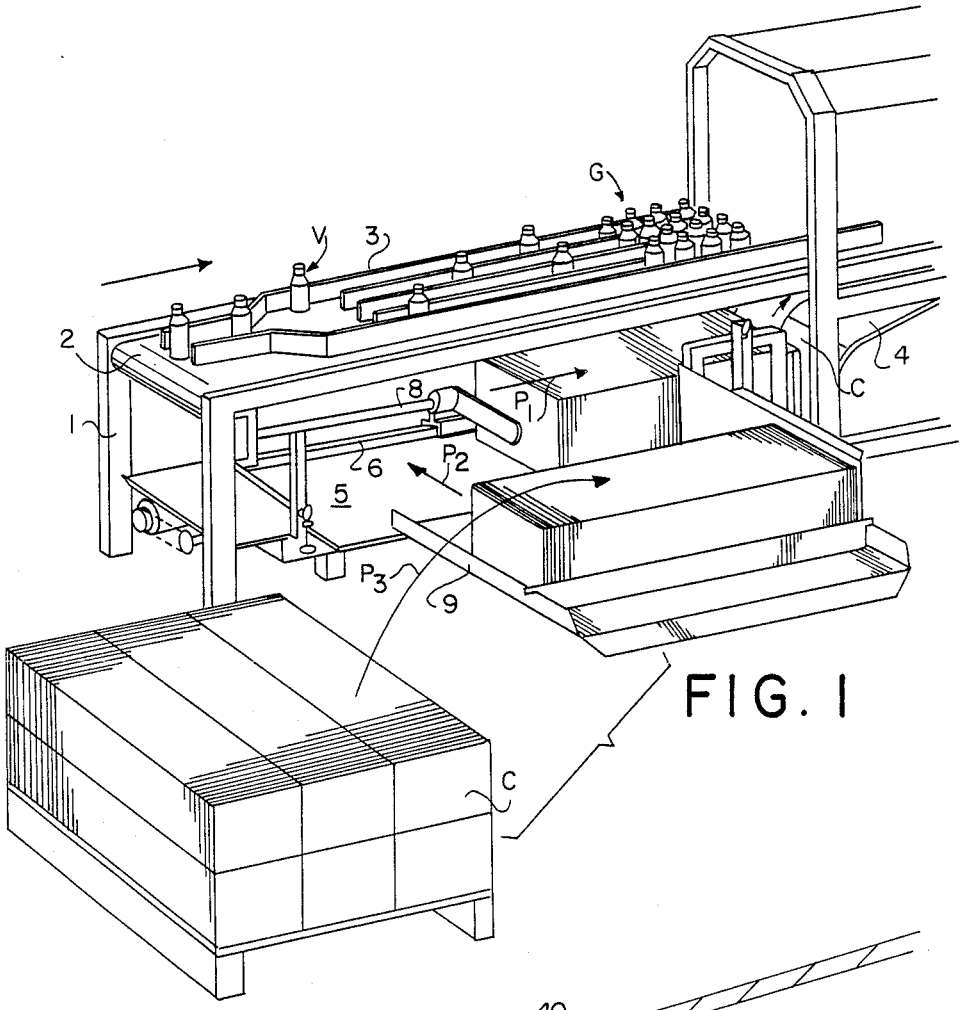

The invention relates to a device for group-wise packaging of objects, such as jars, which device consists substantially of a frame, a belt conveyor carried by the frame, a grouping station disposed along the belt conveyor, a station for forming and feeding of a tray under the group, a station for arranging a covering material over the group of objects standing on the tray and a supply station for the blanks disposed standing in a row which are to be folded in each case into a tray.

A device of the type described in the preamble is normally a part of a handling line in a processing industry, whereby the products, for instance vegetables or drinks, are packed into bottles or jars which are subsequently prepared in the above mentioned device for transport, storage and sale. The production capacity of such a device is usually high and the supply of blanks for a part of the packaging must be replenished at relatively short time intervals. Because of the high processing speed of the objects it is usual for the supply station to be arranged beneath the belt conveyor, which is a position that is difficult of access to personnel. The filling of the supply station is therefore time-consuming and difficult work.

The invention has for its purpose to provide a device whereby the above stated drawbacks are obviated.

The device according to the invention is distinguished in that the supply station is provided with a carrier for accommodating a second row of upright blanks, which carrier can be conveyed from a first position for the arrangement of the row of blanks into a second delivery position and vice versa.

It is possible using this movable carrier to arrange the blanks at a location that is more easily accessible for personnel. The advantage is moreover achieved that using comparatively simple means the time interval can be practically doubled, resulting in personnel having more time for supervising of the further packaging process.

In one embodiment the carrier takes the form of a flat plate, one edge of which rests on the carrying surface of the supply station. The transfer of the blanks to the supply station is hereby realized in simple manner, which further contributes to a disturbance-free feed-in of the blanks.

In order to allow the delivery of the blanks to the belt conveyor to proceed undisturbed, it is recommended according to the invention that a restraining member be arranged for up and downward movement at an interval above the carrying surface. This restraining member ensures not only the sliding of the row of blanks off the carrier when the latter is drawn back, but also the directing of the row relative to the mechanism for individual separation of the blanks from the row.

Above mentioned and other features of the invention will be further elucidated in the figure description of an embodiment following hereinafter.

Figure 4:
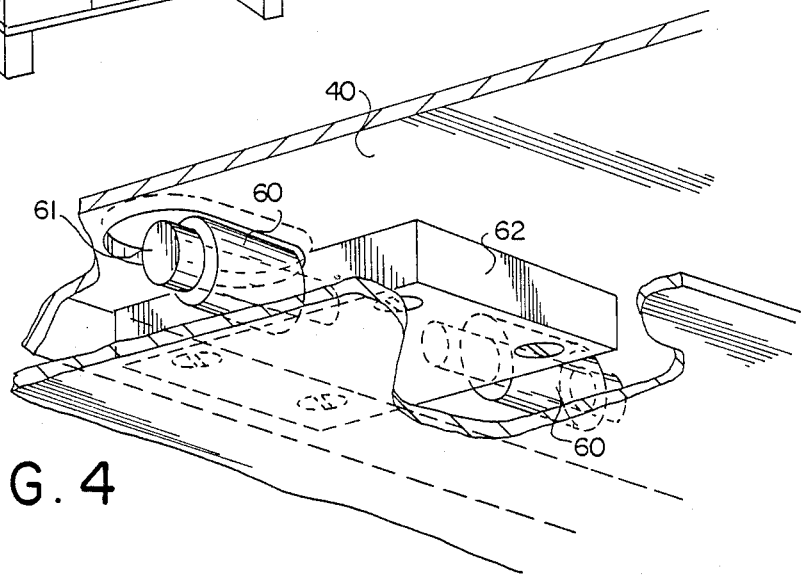
Figure 2:
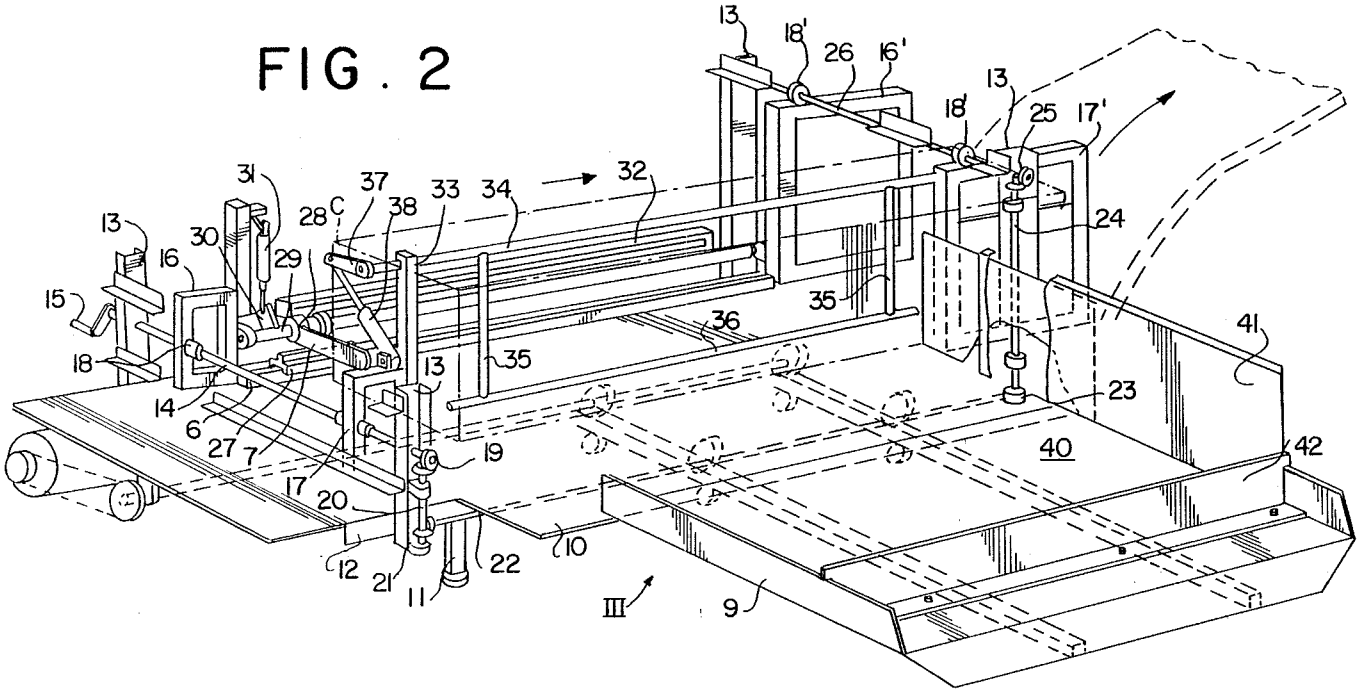
Figure 3:
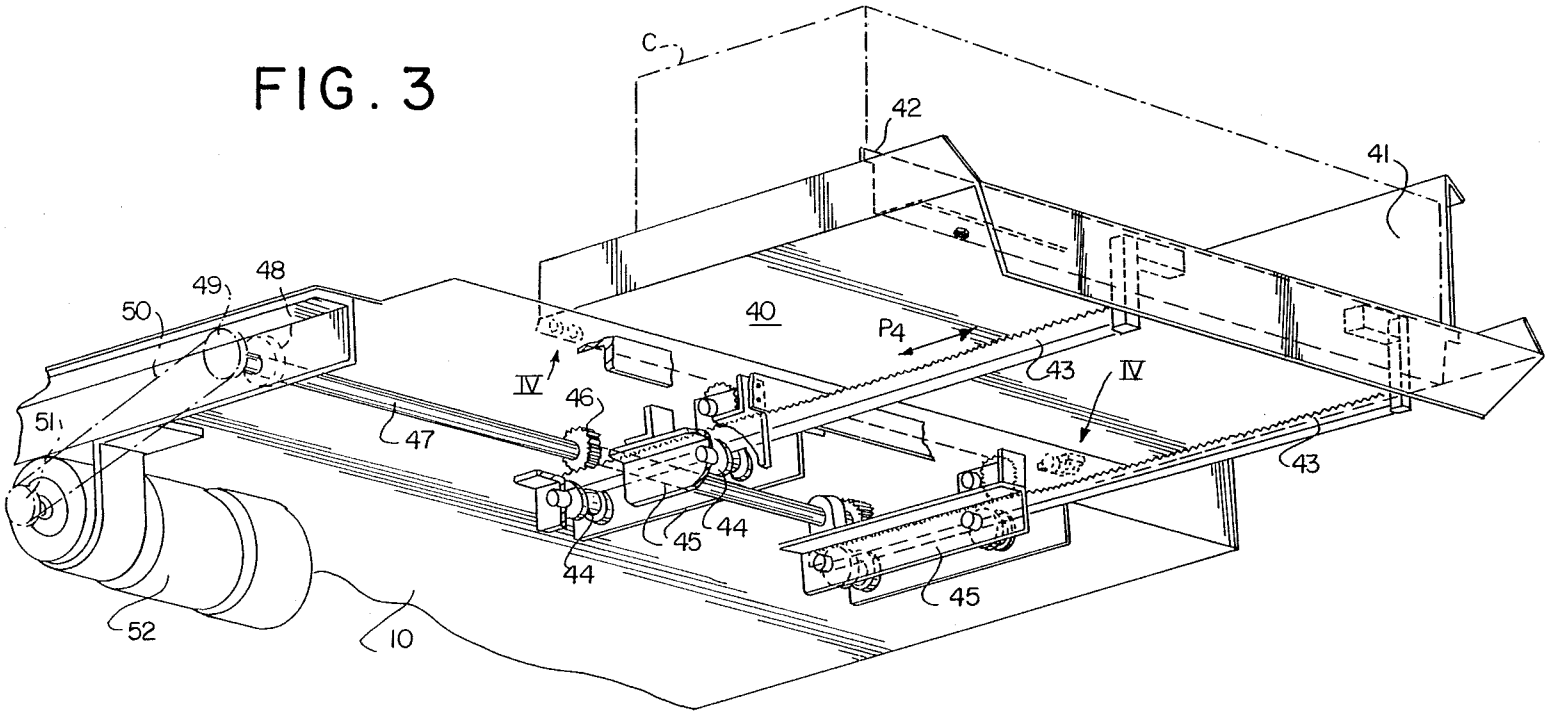

In the drawing:

FIG. 1 shows a perspective view of a portion of the device, namely the grouping station, with supply station arranged thereunder, FIG. 2 shows a perspective view on a larger scale of the supply station in FIG. 1, FIG. 3 is a perspective bottom view of the supply station as seen along the arrow III in FIG. 2, FIG. 4 shows a detail of the movable carrier as along arrow IV in FIG. 3.

The figures show only a part of the packaging device according to the invention, this being the part that is provided with the supply station for the blanks.

The remaining parts of the device are assumed to be known.

The invention is thus formed with a frame 1, which may take a random form, but is here built up of upright posts and girders of suitable material, the frame supporting a belt conveyor 2. Feeding onto belt conveyor 2 is a feed conveyor (not drawn) of another machine, for instance a filling machine, for the glass objects V. The objects arrive in random manner on belt conveyor 2 and are subsequently grouped by means of guide partitions 3 into a particular group G. Such a group of bottles is allowed to pass in succession through a gate system (not shown) to the further packaging stations (likewise not shown).

The device is provided with a feed mechanism 4 using which an individual blank C is fed to the underside of a group of bottles, whereby the edges of the blank are folded upward to form a tray.

The blanks are disposed in a row in a supply station 5 located beneath the grouping station.

Owing to the high handling speed in the direction of the arrow $P_1$ the mechanism for separating off and feeding of one blank at a time has to take as simple a form as possible, which entails the requirement that the row of blanks moves in the direction of the arrow $P_1$.

Fitted along the supply station is a guide 6 for a carrier member 7 in the form of a plate or arm which can swivel upward on the shaft 8. The operation of this carrier member 7 is further explained below.

Arranged according to the invention is a carrier 9 which is movable in the direction of arrow $P_2$ and back again, such that a second row of blanks C, which are placed beforehand on the carrier 9 from a pallet for example, see arrow $P_3$, is carried into alignment with the previous row of blanks being fed by feed member 7 as soon as feed member 7 has moved far enough to the right in FIG. 1.

The supply station will now be further elucidated with reference to the FIGS. 2–4.

The supply station has a carrying surface 10 in the form of a plate which is preferably disposed at a slight inclination such that the left front side in FIG. 2 stands higher than the right rear side by the feed mechanism. The carrying surface 10 is supported for this purpose on adjustable legs 11 which are a part of a support frame 12 supporting the plate 10.

Support frame 12 is formed at its four corners with an upright post 13 which serves to support a screw spindle 14 provided with a hand crank 15, with which sub-frames 16, 17 are mounted above plate 10 for adjustment away from and towards each other. The sub-frames 16, 17 can be placed by means of screw spindle 14 at a distance from each other such that they become suitable for any width of blank C. The sub-frame 16 is formed to this end with a threaded nut 18 which co-acts with the screw thread on spindle 14. The screw thread on spindle 14 which engages nut 18 is a left-hand thread and the screw thread on spindle 14 which engages a similar nut on sub-frame 17 is a right-hand thread so that when spindle 14 is rotated, the sub-frame 16 moves simultaneously with sub-frame 17 towards the middle and away from it respectively.

The spindle 14 is provided on the side opposite crank 15 with a right angle transmission 19, a vertically upright shaft 20 which drives a horizontal shaft 22 with a right angle transmission 21. Shaft 22 is formed on its other end with a right angle transmission 23 for causing an upright shaft 24 to rotate which via right hand transmission 25 causes a spindle 26 similar to spindle 14 to rotate. The parts 16' and 17' of the sub-frame are likewise provided with a threaded nuts 18' which co-operates with a left-handed and right-handed screw thread on the spindle 26 in order thereby to also be able to effect the required setting.

Sub-frame 16 carries the guide 6 for the feed member 7, this latter being supported by a carriage 27 movable along guide 6. Carriage 27 is connected to a socket 28 to which is attached feed member 7 so that the socket moves longitudinally with the carriage, but can rotate with respect thereto. The socket 28 is slidable along a spindle 29 and is rotatable therewith. Spindle 29 is mounted for rotation in the sub-frame parts 16 and 16'. Spindle 29 is attached to an arm 30 on the free end of which is connected a control cylinder 31. As a result of actuation of cylinder 31, the spindle 29 can be turned through a determined angle, carrying with it socket 28 and feed arm 7. The latter can thus be moved from the horizontal position shown in FIG. 2 to a vertical position. Due to the socket being guided along spindle 29 this movement can take place at any random position along the guide 65. The forward movement of carriage 27 along the guide 6 may be carried out in any random manner, for example by means of a cylinder 32.

Cylinder 32 is operated so as to move feed member 7 to the right as seen in FIGS. 1 and 2 to move the stack of blanks substantially continuously toward the feed mechanism 4. When the feed member 7 has moved sufficiently far to the right, a new stack of blanks can be moved into position in alignment with the previous stack of blanks. Feed member 7 is then rotated into a vertical position and cylinder 32 quickly moves the feed member back to the left whereupon the feed member is rotated back into the horizontal feeding position. Cylinder 32 then again moves the feed member to the right, and the cycle of operation of the cylinder is repeated.

The sub-frame 17 is provided with a post 33 at the top end of which a spindle 34 is mounted for rotation, which is likewise mounted for rotation in the frame 17'. Spindle 34 is connected by arms 35 to a restraining member 36. One end of the spindle 34 is formed with an arm 37, the free end of which is connected to a control cylinder 38. It will be noted that sub frames 16, 16' carry guide 6 and support spindle 9 for rotation therebetween. Sub-frames 17, 17' carry the restraining member and the means for operating same.

Setting into operation of control cylinder 38 provides a turning of spindle 34 through a determined angle and in so doing a displacing of the rod 36 from the downward pointing position drawn in FIG. 2 to an outward swivelled position sufficient to be able to convey a row of blanks C underneath it.

Following below is a description of the above mentioned carrier 9 which consists of a tray bent out of sheet material. The bottom 40 serves as a carrying surface for a row of upright blanks C to be arranged therein, whereby for positioning of the row an end wall 41 is disposed perpendicular to the surface 40, as is a front wall 42. Although this is not shown in the drawing these walls can be mounted for adjustment relative to the base plate 40.

The plate 40 is firmly attached on the underside to two toothed racks 43 which extend parallel to each other, see FIG. 3. Each toothed rack 43 is supported on traversing wheels 44 which are mounted for rotation in support plates 45 fastened on the bottom of carrying surface 10 of the supply station. Placed on the top between the carrying surface 10 and rack bar 43 is a pinion 46 which is non-rotatably attached to a drive shaft 47. This latter is mounted for rotation in bearing mountings 48 on the underside of carrying plate 10. The free end of the drive shaft 47 is formed with a chain wheel 49 around which is passed a chain 50 which is driven on a driving wheel 51 of a motor transmission unit 52.

It will be apparent that through driving of motor 52 in the one or other direction the drive shaft 47 may be rotated and thereby the toothed racks 43 can be moved reciprocally in the direction of arrow $P_4$, carrying with them the carrier 9.

The above described device works as follows:

Starting from the position of carrier 9 drawn in FIG. 1, an operator will be able to place a row of blanks C from the pallet onto carrier 9 such that the right-hand blank in FIG. 1 rests against the end wall 41. The row is thereby oriented such that it extends along the front wall 42.

As soon as the row of blanks in the supply station has dwindled such that the carrier member 7 has moved far to the right in FIG. 1, the motor 52 can be actuated, as a result of which the carrier 9 is moved inward, such that the row of blanks C lying thereon will extend between sub-frames 16, 17. The latter can be positioned at the correct distance beforehand by means of the crank 15.

Through actuation of cylinder 29 the carrier 7 is carried into an upward position and can be returned along guiding 6 to the position in FIG. 2. Carrier member 7 can then be rotated back into position behind the rearmost blank in the row.

Cylinder 38 is subsequently actuated such that the rod 36, which was located high above the carrying surface 10, is swivelled into the position drawn in FIG. 2. Through actuation of motor 52 in opposing direction the toothed racks 43 are again pressed outward, taking with them the carrier 9, which results in the row of blanks being pressed against bar 36 and being thus brought into alignment. As a result of driving the row of blanks further in the direction of arrow $P_1$, pick-off of the blanks by the mechanism 4 can be further carried out without interruption. The locating mechanism 36 restrains the row of blanks so that the surface 40 again becomes free for a following row of blanks from the pallet.

The above described operation can be performed completely automatically by means of proximity cells arranged at suitable positions, for example light cells which set the various parts into operation, and the operators are relieved of frequent reloading. The operator is only required to arrange two rows of blanks in the station a short time after each other, which results in the interval time being practically doubled.

It is finally remarked that the friction between the plate-like carrier 9 and the carrying surface 10 of the supply station can be reduced by the rolls 60 as shown in FIG. 4, which are mounted for free rotation on a spindle 61 which is rigidly attached in a block 62 screwed in position on the underside of base plate 40. Two rolls 60 per block 62 are shown in FIG. 4 but it will be apparent that the number thereof is entirely random and dependent on the dimensions of carrier 9.

The invention is not limited to the above described embodiment, whereby it may be noted that the mechanism can be operated in mirror image symmetrically relative to the upright central plane between the sub-frames 16, 17. That is, a carrier 9 may also be placed on the other side of the frame 1.

The carrier 9 may in addition be disposed at an inclined angle relative to the horizontal in order to facilitate feed-in of the row of blanks.

It is further remarked that the base plate 40 may also display an angle of inclination similar to that of carrying surface 10, but may also be inclined at an angle differing therefrom.

Finally, the adjusting mechanism for the sub-frames 16,17 does not necessarily have to directly form part of the supply station.

I claim:

1. In a packaging machine for receiving objects to be packed and including a belt conveyer receiving the objects successively at one end of the conveyer belt and grouping the objects into groups of finite numbers of objects adjacent the opposite end of the conveyer belt for delivery to packaging mechanism, means for holding and feeding a stack of flat blanks longitudinally beneath the conveyer belt and forming means for successively folding the edges of individual flat blanks into trays disposed beyond and beneath a group of objects which has been grouped, the improvement comprising a carrier for receiving a further stack of collapsed blanks at substantially the height of the means for holding and feeding but in laterally displaced position relative thereto, and transfer means for transferring the further stack onto the means for holding and feeding to augment and expand the stack of blanks being held and

2. In a packaging machine as defined in claim 1 wherein the transfer means is in the form of a plate having upstanding edges to retain the further stack of blanks.

3. A packaging machine comprising the combination of conveyer means for feeding ojects to a grouping station, means for holding and feeding a stack of flat blanks beneath the conveyer means to a region below the grouping station, carrier means for receiving a further stack of flat blanks in offset relation to the means for holding and feeding, and transfer means for transferring the further stack behind the flat blanks remaining on the means for holding and feeding when the supply of flat blanks thereon has dwindled by a predetermined amount to augment and expand the stack of blanks being held and fed.

4. A device for packaging groups of objects comprising, conveying means for conveying objects, means for grouping said objects on said conveying means, means for forming a tray for said grouped objects from individual blanks received from a stack of blanks, supply means for supplying said blanks, said supply means including a carrying surface for supporting a stack of upright blanks, feed means for engaging and substantially continuously feeding said stack of blanks toward said forming means in a first direction, carrier means for supporting an additional stack of blanks, and means for intermittently moving said carrier means to move said additional stack of blanks into alignment with said first-mentioned stack of blanks while said first-mentioned stack of blanks is being fed in said first direction.

5. A device as defined in claim 4 wherein said carrier means includes a flat plate means one edge of which is supported by said supply means.

6. A device as defined in claim 4 including antifriction means between said edge and said supply means.

7. A device as defined in claim 4 including restraining means supported for intermittent movement into and out of position for engaging ends of said blanks supported by said carrier means to align such ends, and means for intermittently operating said operating means.

8. A device as defined in claim 4 including a plurality of sub-frame means, means for adjusting the position of said sub-frame means relative to said carrying surface, said restraining means being swingably carried by said sub-frame means.

9. A device as defined in claim 4 wherein said carrier means includes a support surface, said support surface and said carrying surface being disposed at an angle to horizontal.

10. A device as defined in claim 4 wherein said feed means is mounted for reciprocating movement toward and away from said forming means and includes a feed member which is mounted for movement from a first position for engaging the last blank in a particular stack of blanks to a second position out of engagement with a blank and providing clearance for a new stack of blanks to be moved into position in alignment with said particular stack of blanks.

11. A device as defined in claim 10 including restraining means mounted for swinging movement into and out of position for engaging ends of a stack of blanks, and means for swinging said restraining means out of position for engaging a stack of blanks as a stack of blanks is moved by said carrier means into alignment with a previous stack of blanks, and swinging said restraining means back into position for engaging ends of a stack of blanks after the stack of blanks has been moved into said alignment.

* * * * *